US009784290B2

(12) United States Patent
Cooper

(10) Patent No.: US 9,784,290 B2
(45) Date of Patent: Oct. 10, 2017

(54) SWIVEL CAP

(71) Applicant: SPX Corporation, Charlotte, NC (US)

(72) Inventor: James E. Cooper, Menomonee Falls, WI (US)

(73) Assignee: SPX Flow, Inc., Charlotte, NC (US)

( * ) Notice: Subject to any disclaimer, the term of this patent is extended or adjusted under 35 U.S.C. 154(b) by 664 days.

(21) Appl. No.: 14/250,615

(22) Filed: Apr. 11, 2014

(65) Prior Publication Data

US 2014/0308066 A1 Oct. 16, 2014

Related U.S. Application Data

(60) Provisional application No. 61/811,575, filed on Apr. 12, 2013.

(51) Int. Cl.
*F15B 15/14* (2006.01)

(52) U.S. Cl.
CPC ..... *F15B 15/1447* (2013.01); *Y10T 29/49826* (2015.01); *Y10T 403/32606* (2015.01)

(58) Field of Classification Search
CPC ..... F15B 15/00; F15B 15/02; F15B 15/20; F15B 15/26; F15B 15/1447; Y10T 403/32606; Y10T 403/32622; F16C 11/0623; F16C 11/0647; F16C 11/0619
See application file for complete search history.

(56) References Cited

U.S. PATENT DOCUMENTS 470,397 A 3/1892 Jerome
986,029 A 3/1911 Steinert
2,503,659 A 4/1950 Curtis
3,006,606 A 10/1961 Pohl et al.
3,053,595 A 9/1962 Dilworth
3,096,986 A 7/1963 David
4,173,329 A * 11/1979 Stith, Jr. ..... B23Q 1/0054 254/93 R (Continued)

FOREIGN PATENT DOCUMENTS

CN 1062021 6/1992
CN 1040144 10/1998

(Continued)

OTHER PUBLICATIONS

International Search Report issued in International Patent Application No. PCT/US15/41540 mailed Oct. 13, 2015.

(Continued)

*Primary Examiner* — Jonathan Masinick
(74) *Attorney, Agent, or Firm* — Baker Hostetler LLP

(57) ABSTRACT

An actuator is provided. The actuator includes a rod having a socket portion at one distal end of the rod and a swivel cap. The swivel cap includes a base portion having an inner surface and an outer surface and a raised domed portion disposed on the inner surface of the base portion. The outer surface has an origin of the radius at the center of the plane that defines the outer surface of the base portion. The raised domed portion is mounted on the socket portion of the rod and has an origin of the radius on the plane that defines the outer surface of the base portion. A raised region is located on at least one of the raised domed portion or the socket portion. The swivel cap tilts relative to the rod in response to angular misalignment with a load to a tilt angle.

18 Claims, 4 Drawing Sheets

(56) References Cited

U.S. PATENT DOCUMENTS

| | | | | |
|---|---|---|---|---|
| 4,457,212 | A | 7/1984 | Unger et al. | |
| 4,653,339 | A | 3/1987 | Komatsu et al. | |
| 5,442,993 | A | 8/1995 | Baliotti, II et al. | |
| 5,509,748 | A | 4/1996 | Idosako et al. | |
| 6,152,640 | A * | 11/2000 | Oda | F16C 11/0638 403/133 |
| 7,040,812 | B2 * | 5/2006 | Boshier | F16C 11/0623 29/898.046 |
| 7,343,846 | B2 * | 3/2008 | Stanford | B66F 3/30 92/18 |
| 2006/0260462 | A1 | 11/2006 | Stanford et al. | |
| 2013/0199327 | A1 * | 8/2013 | Park | B25J 18/06 74/490.04 |
| 2015/0184682 | A1 | 7/2015 | Cooper et al. | |

FOREIGN PATENT DOCUMENTS

| | | | |
|---|---|---|---|
| CN | 1287228 | | 3/2001 |
| CN | 1759254 | | 4/2006 |
| DE | 1 151 428 | | 7/1963 |
| DE | 32 45 186 | A1 | 6/1984 |
| WO | 2004081377 | | 9/2004 |
| WO | 2009/103762 | A1 | 8/2009 |
| WO | 2010/142606 | A2 | 12/2010 |
| WO | 2014169194 | | 10/2014 |
| WO | 2016014667 | | 1/2016 |

OTHER PUBLICATIONS

Chinese Office Action dated Aug. 2, 2016.

International Search Report mailed Aug. 28, 2014 in corresponding Appl. No. PCT/US2014/033772.

Written Opinion of the International Searching Authority mailed Aug. 28, 2014 in corresponding Appl. No. PCT/US2014/033772.

United Kingdom Search Report dated Aug. 10, 2016, in Great Britain Patent Application No. GB 1604073.5.

European Search Report issued in European Patent Application No. 14782340.5 mailed Nov. 4, 2016.

US Office Action dated Dec. 1, 2016, in U.S. Appl. No. 14/338,102.

* cited by examiner

SWIVEL CAP

CROSS-REFERENCE TO RELATED APPLICATIONS

This application claims priority to provisional U.S. patent application entitled, Swivel Cap, filed Apr. 12, 2013, having a Ser. No. 61/811,575, the disclosure of which is hereby incorporated by reference in its entirety.

TECHNICAL FIELD

This patent disclosure relates generally to actuators and, more particularly, to swivel caps for rods used in actuators to reduce bending moments and reduce side movement.

BACKGROUND

An actuator is a mechanism often used to lift or move an object or to clamp an object to prevent motion. An actuator may introduce linear or non-linear motion. Examples of actuators include hydraulic cylinders, pneumatic cylinders, electrical motors, etc. Actuators are used in many applications, including construction equipment, engineering vehicles and manufacturing machinery. For example, the hydraulic cylinder is a mechanical actuator that may provide a unidirectional force through a unidirectional stroke. The hydraulic cylinder consists of a cylinder barrel in which a piston connected to a rod moves back and forth.

Actuators suffer from disadvantages or drawbacks associated with the misalignment of the rod. This misalignment may be the result of setting poorly balanced or off-center loads on the cylinder. This may occur for example, when the rod contacts an uneven surface. This problem may cause damage to the cylinder and the cylinder may ultimately fail.

Much effort has been made by manufacturers of hydraulic cylinders to reduce or eliminate the side loading of cylinders created as a result of misalignment. It is almost impossible to achieve perfect alignment of a hydraulic cylinder, even though the alignment of the cylinder has a direct impact on the longevity of the hydraulic cylinder. Actuators for many applications are custom made and expensive so prolonging their life and operation can represent significant savings.

These prior art methods and systems, however, have not sufficiently reduced or eliminated bending moments that cause stress on the rod and ultimately lead to rod failure. Therefore, there is a need for actuators that can operate to reduce bending moments that can potentially cause the cylinder assembly to fail.

The presently disclosed system and method is directed at overcoming one or more of these disadvantages in currently available actuators.

SUMMARY

In accordance with some embodiments of the present disclosure, an actuator is provided. The actuator includes a rod having a socket portion at one distal end of the rod and a swivel cap. The swivel cap includes a base portion having an inner surface, an outer surface having an origin of the radius at the center of the plane that defines the outer surface of the base portion, and a raised domed portion disposed on the inner surface of the base portion. The raised domed portion is mounted in the socket portion of the rod. A raised region is located on at least one of the raised domed portion or the socket portion. The swivel cap tilts relative to the rod in response to angular misalignment with a load to a tilt angle.

In accordance with some embodiments of the present disclosure, a method of assembling an actuator is provided. The method includes the steps of forming a rod having a socket portion at one distal end of the rod and forming a swivel cap. The swivel cap formed includes a base portion having an inner surface, an outer surface having an origin of the radius at the center of the plane that defines the outer surface of the base portion, and a raised domed portion. The raised domed portion is disposed on the inner surface of the base portion and mounted in the socket portion of the rod. A raised region is located on at least one of the raised domed portion or the socket portion. The swivel cap tilts relative to the rod in response to angular misalignment with a load to a tilt angle.

In accordance with some embodiments of the present disclosure, an actuator that includes a means for forming a rod having a socket portion at one distal end of the rod and a means for forming a swivel cap is provided. The swivel cap includes a base portion having an inner surface and an outer surface having an origin of the radius at the center of the plane that defines the outer surface of the base portion, and a raised domed portion. The raised domed portion is disposed in the inner surface of the base portion and mounted on the socket portion of the rod. A raised region is located on at least one of the raised domed portion or the socket portion. The swivel cap tilts relative to the rod in response to angular misalignment with a load to a tilt angle.

In this respect, before explaining at least one embodiment of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the invention. It is important, therefore, that the claims be regarded as including such equivalent constructions insofar as they do not depart from the spirit and scope of the invention.

DETAILED DESCRIPTION

Figure 1:
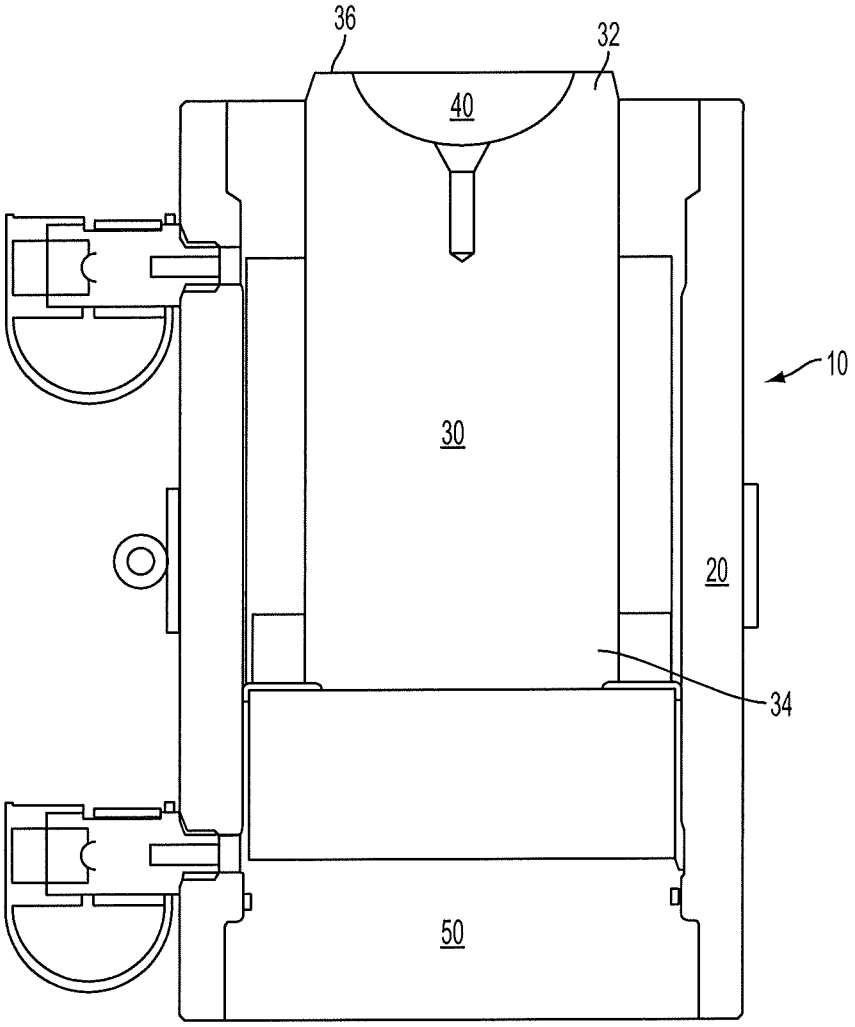
FIG. 1 presents a cross sectional view of an actuator showing the rod and the socket portion in accordance with the present disclosure.

Referring now to FIG. 1, a cross sectional view of an actuator 10 according to the present disclosure is shown. The actuator 10 shown and discussed below is a hydraulic cylinder assembly. Although, the disclosure is not meant to be limited to a hydraulic cylinder. The principles of the disclosure may be applied to other types of actuators, such as hydraulic, pneumatic, electric and any other type of actuator.

The hydraulic cylinder assembly 10 has a barrel 20 and a rod 30. The rod 30 is slidably received in the barrel 20 and extends through the barrel 20. The rod 30 has two ends 32, 34. The rod 30 has a socket portion 40 at one end 32. The actuator 10 has a base 50 near the end 34 opposing the socket portion 40. In some embodiments according to the present disclosure, the rod 30 may be cylindrical. Other geometries, however, may be used for the rod 30. In the present disclosure, the term rod 30 is used to refer to the rod and is also used to refer to a single piece that combines the piston and rod. The socket portion 40 of the rod 30 may be a separate attachment to the rod 30. Alternatively, the rod 30 may be fabricated as a single piece with the socket portion 40.

Figure 2:
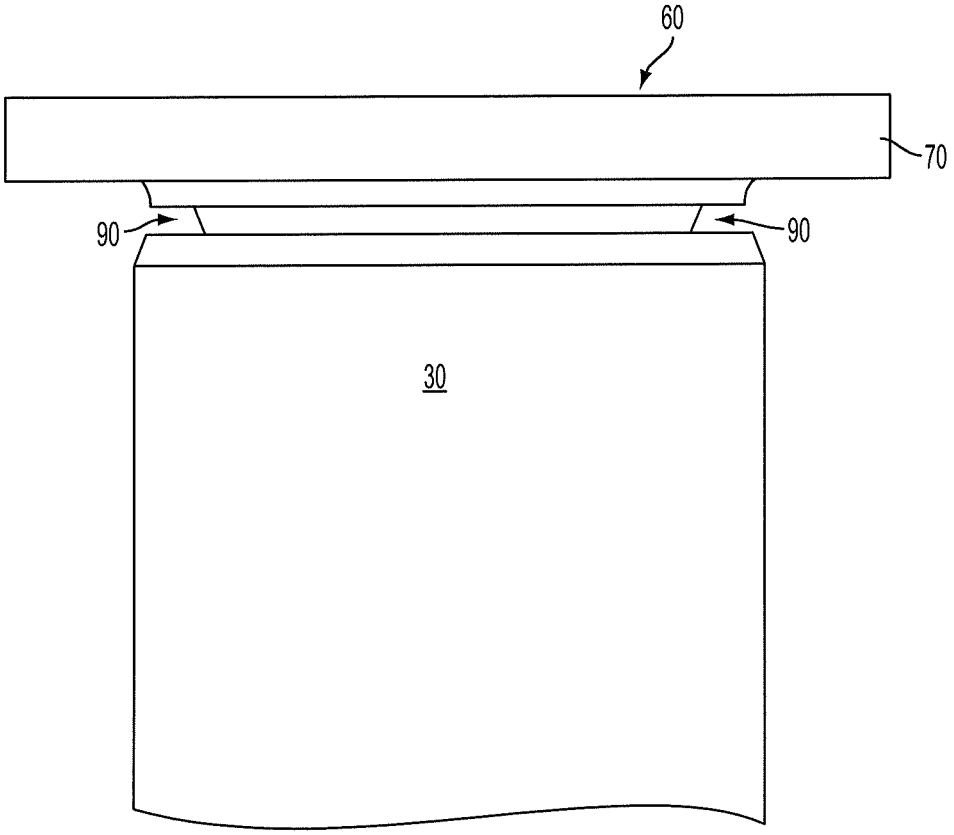
FIG. 2 presents a side view of a swivel cap shown with the rod in accordance with the present disclosure.
Figure 3:
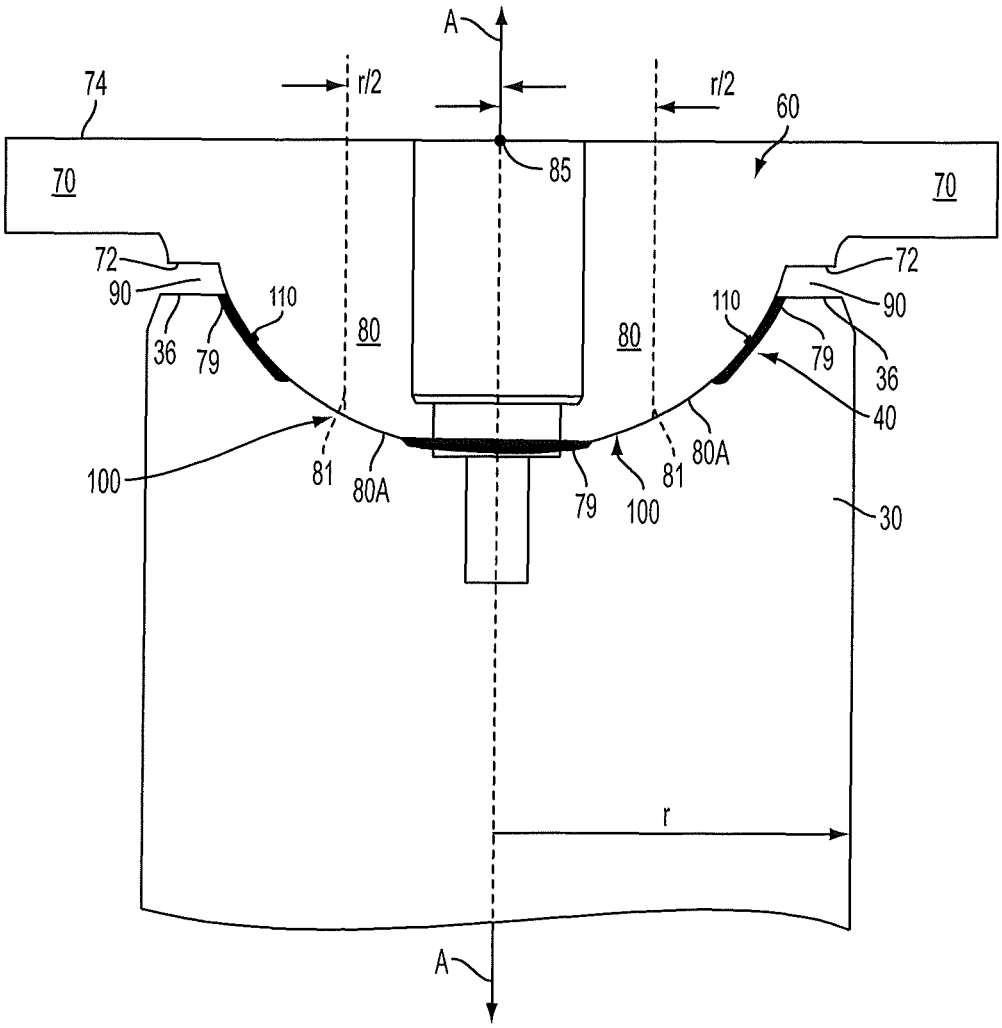
FIG. 3 presents a cross-sectional view of a swivel cap in accordance with the present disclosure.

The hydraulic cylinder assembly 10 also has a swivel cap 60. A perspective view of the swivel cap 60 and a distal end the rod 30 is shown in FIG. 2. A cross-sectional view of the swivel cap 60 with a distal end of the rod 30 is shown in FIG. 3.

Figure 4:
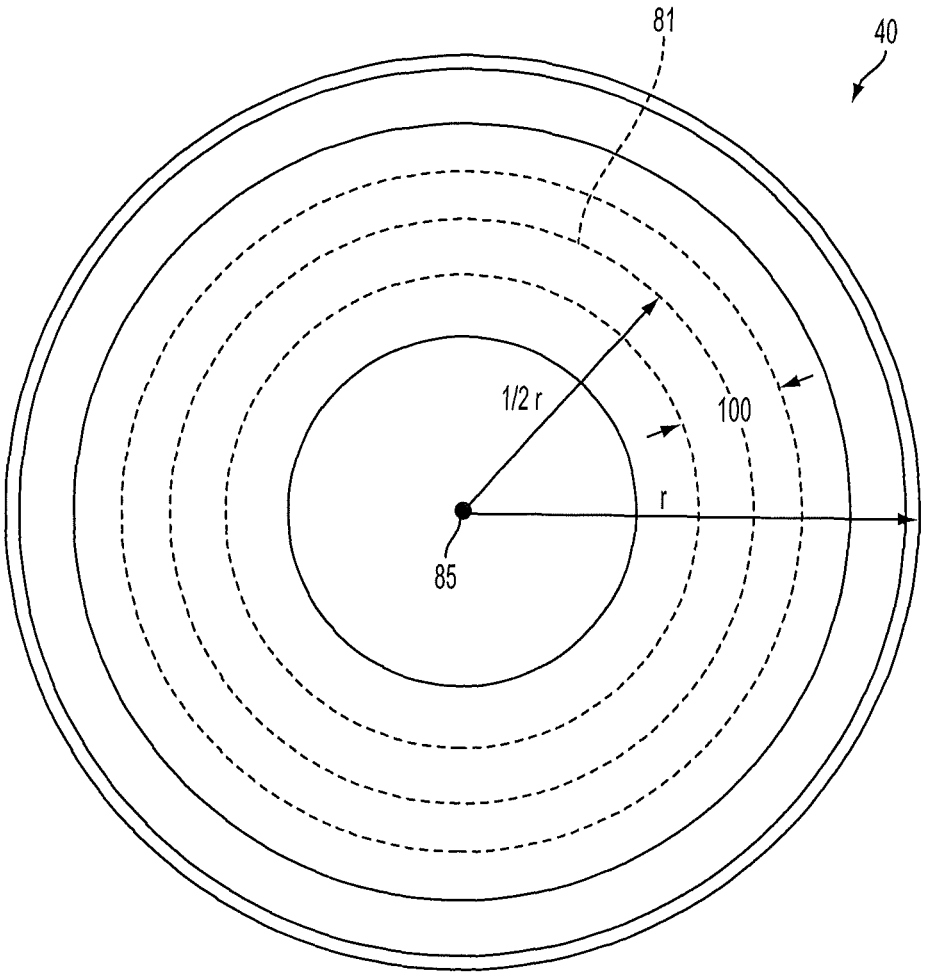
FIG. 4 presents a top view of the socket portion of the rod in accordance with the present disclosure.

The swivel cap 60 includes a base portion 70 and a raised dome portion 80. The base portion 70 of the swivel cap 60 has an inner surface 72 and an outer surface 74. As shown in FIGS. 3 and 4, the raised domed portion 80 of the swivel cap 60 is disposed on the inner surface 72 of the base portion 70. The raised domed portion 80 may be mounted in the socket portion 40 of the rod 30. The base portion 70 and the raised dome portion 80 are typically formed from a metal such as steel and may be formed from the same material that is used to form the rod 30. Other materials, however, may be used to form the base portion 70 and the raised dome portion 80 as long as the materials selected have sufficient strength for the cylinder assembly 10 application. The base portion 70 may be circular.

The raised domed portion 80 is dome-shaped or hemispherical and is shaped to accommodate the socket portion 40 (See FIG. 4) of the rod 30. The raised domed portion 80 of the swivel cap 60 has a central axis that is positioned generally in line with the axis A of the rod 30. The raised domed portion 80 has an origin of the radius 85, which is located on the plane that defines the outer surface 74 of the base portion 70. This particular location of the origin of the radius 85 provides zero side movement during the rotation of the swivel cap 60 and reduces the bending moments in the rod 30. The origin of the radius 85 of the raised domed portion 80 is along the central axis at the center of the plane that defines the outer surface of the base portion. The origin of the radius 85 is shown in FIGS. 3 and 4. The axis A is shown in FIG. 3.

In some embodiments according to the present disclosure, the base portion 70 is circular and the rod 30 is cylindrical. FIGS. 2 and 3 show a cylindrical rod 30 and a circular base portion 70. In some embodiments, the diameter of the base portion 70 less then, greater than, or equal to the diameter of the outer diameter of the rod 30. In FIGS. 2 and 3, the diameter of the base portion 70 is greater than the outer diameter of the rod 30.

It is generally desirable to have a base portion 70 that is larger than the planar face 36 of the rod 30 because the larger base portion 70 can protect the object that the actuator is acting upon. Often when an actuator 10 is in operation, the object that it is lifting, moving, or clamping may be damaged by stress and deformation by rod 30. The large base portion 70, however, can prevent this damage. Because the diameter of the circular base portion 70 is at least as large as the outer diameter of the cylindrical rod 30, the base portion 70 protects the distal end of the rod 30 and in particular the planar face 36 of the rod 30 at the distal end of the rod 30. Furthermore, given the geometry of the swivel cap 60 according to the present disclosure and the contact area of the dome portion 80, the size of base portion 70 will not affect the rating of the hydraulic cylinder assembly 10 nor will it adversely affect the performance of the hydraulic cylinder assembly 10. In some embodiments of the present disclosure, the ratio of the surface area of the base portion 70 to surface area of the planar face 36 of the rod 30 may vary from 1:1 to 2:1 or more.

As described above, hydraulic cylinder assemblies 10 experience difficulties due to angular misalignment of the load applied to the rod 30. This may be caused for example by overloading due to misalignment of the rod 30 during operation of the hydraulic cylinder assembly 10, which may be partly due to the direction of the load changing during a lift. The angular misalignment of the rod 30 causes bending moments in the rod 30 which will cause the rod 30 to fail and the cylinder assembly 10 to fail. Therefore, it is important to eliminate or at least reduce bending moments in the rod 30, such that the rod 30 does not fail and the hydraulic cylinder assembly 10 is operational for as long as possible.

The hydraulic cylinder assembly 10 includes a swivel cap 60, which is designed to protect the rod 30 from this damage due to angular misalignment. The swivel cap 60 is mounted to the end 32 of the rod 30. The swivel cap 60 tilts relative to the rod 30 in response to angular misalignment with a load to a tilt angle. In some embodiments according to the present disclosure, the tilt angle of the swivel cap 60 is less than or equal to 5 degrees. In other embodiments, cylinders may be designed for tilt angles exceeding 5 degrees.

The socket portion 40 is sized to accommodate the raised domed portion 80 of the swivel cap 60 and vice versa. FIG. 4 illustrates a top view of the socket portion 40 of the rod 30 in accordance with the present disclosure. The socket portion 40, however, is not shaped or sized to exactly fit the raised domed portion 80. For example, FIG. 3 shows that a gap 90 is formed between the planar face 36 of the end 32 of the rod 30 and the inner surface 72 of the swivel cap 60.

The gap 90 provides a visual indication for the user of the hydraulic cylinder assembly 10 to know when the maximum tilt angle has been violated. This is important because the rod 30 may become damaged if the rod 30 is operated at a tilt angle beyond the maximum tilt angle. As the swivel cap 60 tilts in response to the angular misalignment of the rod 30, a portion of the inner surface 72 of the base portion 70 will contact the planar face 36 of the rod 30 when the swivel cap 60 tilts at or exceeds the maximum tilt angle. The gap 90 will close where the contact occurs between the inner surface 72 of the base portion 70 and the planar face 36 of the rod 30. A gap 90, however, remains between the remaining portions of the inner surface 72 of the base portion 70 (i.e., the portions that do not contact the planar surface of the rod) and the planar face 36 of the rod 30. In other words, the gap 90 will not be uniform between the base portion 70 and the planar face 36 of the rod as the swivel cap 60 rotates.

The user of the hydraulic assembly 10 will be able to visually detect during operation whether or not the maximum tilt angle has been reached or exceeded because the gap 90 will disappear at some portion of the inner surface 72 of the base portion 70. This feature allows the user to stop the operation of the hydraulic cylinder assembly 10 before the rod 30 is damaged.

If the rod 30 is operated such that the swivel cap 60 tilts at a tilt angle that is greater than the maximum tilt angle, then the inner surface 72 of the base portion 70 will form a dent or depression in the planar face 36 of the rod 30. Alternatively, the dent or depression may occur on the inner surface 72 of the base portion 70. This dent or depression is caused by the contact between the base portion 70 and the planar surface of the rod 30. Alternatively, the dent or depression may occur on the inner surface 72 of the base portion 70. The magnitude of the dent will be a function of the load and the amount of misalignment. The rod's planar surface and/or the base portion's inner surface 72 can then be inspected to reveal whether or not the hydraulic cylinder assembly 10 was operated beyond its load specifications.

Therefore, the gap 90 ultimately provides two advantages for the user of the hydraulic cylinder assembly 10. First, the user of the hydraulic cylinder assembly 10 has a visual indicator for the maximum tilt during use. Second, the dent or depression provided on the rod 30 will indicate that rod 30 was operated beyond its load specifications. Knowing whether or not, a rod 30 is being operated within its design specifications can be useful information for both the user and the manufacturer. For example, if the rod 30 is being operated within its design specifications, then there will be no dent and any failure in the rod may be due to manufacturing defect. On the other hand, a dent indicates that the load specifications for the hydraulic cylinder assembly 10 have been violated and any rod failure was caused by the user.

The swivel cap 60 according to the present disclosure is designed to have a minimal amount of contact with the rod 30. The raised domed portion 80 of the swivel cap 60 contacts the rod 30 at the socket portion 40. The contact between the socket portion 40 and the raised domed portion 80 is limited to a certain area within the socket portion 40 of the rod 30. The contact area 80A is located within the socket portion 40 of the rod and can be seen in FIG. 3.

The swivel cap 60 may further include a raised region 100 that is located on either the raised domed portion 80 or the socket portion 40. In some embodiments, the raised region 100 is on the raised domed portion 80. In other embodiments, the raised region 100 may be on the socket portion 40 as shown in FIG. 3. The raised region 100 may have a center portion 81 located at about one half the length (r/2) of the radius (r) from the axis A of the swivel cap 60. The size and specific geometry of the raised region 100 may vary depending on how much contact is desired between the swivel cap 60 and the socket portion 40 of the rod 30.

The raised region 100 may be a region of the raised domed portion 80 that is raised from the outer surface of the raised domed portion 80. Alternatively, the raised region 100 may be a region within the socket portion 40 that is raised from the surface 79 of the socket portion 40. The raised region 100 is significant because it facilitates reducing the contact between the socket portion 40 and the raised domed portion 80. As explained further below, minimizing and controlling this contact area controls the bending moments and ultimately prolongs the service of the rod 30.

If the contact area was, for example, the entire surface area of the socket portion 40 of the rod 30, then the rod 30 would experience more bending moments and there would be a greater chance the rod 30 would fail under the stress of the bending moments. However, by minimizing the contact area between the raised domed portion 80 of the swivel cap 60 and the socket portion 40 of the rod 30, the bending moments are controlled and the rod 30 experiences less stress thereby reducing the chance of rod 30 failure.

The swivel cap 60 is able to tilt to a certain extent relative to the rod 30 in response to a load. This tilting may take place about the origin of the radius 85 and between the contact surfaces 80A. The swivel cap 60 is able to keep the loads in the center of the rod 30, through the contact surface 80A. The contact surface 80A controls or limits the bending moment through the cylinder assembly 30, thereby reducing the chances that the rod 30 will become damaged or fail.

The axis (as shown by axis A of FIG. 3) of raised domed portion 80 of the swivel cap 60 is positioned generally coaxial with the axis A of the rod 30. The origin of the radius 85 of the raised domed portion 80 is along axis A and positioned on the outer surface 74 of the base portion 70.

There may be one or more tilt indicators 110 that are located on the outer surface of the raised domed portion some distance above the contact surface 80A. In some embodiments, there may be two tilt indicators 110 that is a circular groove as shown in FIG. 3. Because the tilt indicators 110 are located outside of the contact surface 80A, any sign of damage or stress above the tilt indicator 110 shows that the hydraulic cylinder assembly 10 has been operated beyond its load specifications. Conversely, any sign of damage or stress below the tilt indicators 110 shows that the hydraulic cylinder assembly 10 has been operated within load specifications.

In some embodiments according to the present disclosure, the hydraulic cylinder assembly 10 may include a seal (not shown). The seal may be an annular contamination seal and may be disposed around the raised domed portion 80. The seal may be useful to prevent the entry of dirt or debris from entering socket portion 40 and raised domed portion 80.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. An actuator comprising:

a rod having a socket portion at one distal end of the rod; and a swivel cap including:

a base portion having an inner surface and an outer surface;

a raised domed portion disposed on the inner surface of the base portion and mounted in the socket portion of the rod and tilt indicator notches on the raised domed portion; and a raised region located on at least one of the raised domed portion or the socket portion;

wherein the swivel cap tilts relative to the rod in response to angular misalignment with a load to a tilt angle.

2. The actuator of claim 1, wherein the raised region is on the raised domed portion of the swivel cap.

3. The actuator of claim 1, wherein the raised region is on the socket portion of the rod.

4. The actuator of claim 1, further comprising a planar face disposed on the distal end of the rod and a gap between the planar face of the distal end of the rod and the base portion of the swivel cap.

5. The actuator of claim 1, wherein the tilt angle is less than or equal to 5 degrees.

6. The actuator of claim 1, wherein the raised region has a center portion located at half the length of a radius from a center axis of the swivel cap.

7. The actuator of claim 1, wherein the base portion of the swivel cap is circular.

8. The actuator of claim 7, wherein the base portion has a diameter that is equal to or greater than the outer diameter of the rod.

9. The actuator of claim 1, wherein the base portion of the swivel cap is circular and has a diameter that is equal to or greater than the outer diameter of the rod.

10. The actuator of claim 1, wherein the distal end of the rod includes a planar face and the inner surface of the base portion contacts the planar face of the distal end of the rod and mars at least one of the base portion and planar face when the tilt angle is equal to or greater than 5 degrees.

11. A method of assembling an actuator comprising:

forming a rod having a socket portion at one distal end of the rod and forming a swivel cap including:

a base portion having an inner surface and an outer surface having a partially spherical shape defined, in part, by a radius having an origin on the outer surface;

a raised domed portion disposed in the inner surface of the base portion and mounted on the socket portion of the rod and tilt indicator notches on the raised domed portion;

a raised region located on at least one of the raised domed portion or the socket portion; and wherein the swivel cap tilts relative to the rod in response to angular misalignment with a load to a tilt angle.

12. The method of claim 11, further comprising forming a gap between a planar face of the distal end of the rod and the base portion of the swivel cap.

13. The method of claim 11, wherein the tilt angle is less than or equal to 5 degrees.

14. The method of claim 11, further comprising forming a seal disposed around the raised domed portion of the swivel cap.

15. The method of claim 11, wherein the rod is a cylindrical rod.

16. The method of claim 11, wherein the base portion of the swivel cap is circular.

17. The method of claim 11, wherein the base portion of the swivel cap is circular and has a diameter that is, smaller than, equal to or greater than the outer diameter of the rod.

18. The method of claim 11, wherein the distal end of the rod includes a planar face and the inner surface of the base portion contacts the planar face of the distal end of the rod when the tilt angle is equal to or greater than 5 degrees.

* * * * *